US009834427B2

(12) United States Patent
Williams

(10) Patent No.: US 9,834,427 B2
(45) Date of Patent: Dec. 5, 2017

(54) KEG ADAPTER APPARATUS, SYSTEMS AND METHODS OF USING SAME

(71) Applicant: Scott Williams, Lower Lake, CA (US)

(72) Inventor: Scott Williams, Lower Lake, CA (US)

( * ) Notice: Subject to any disclaimer, the term of this patent is extended or adjusted under 35 U.S.C. 154(b) by 31 days.

(21) Appl. No.: 14/903,003

(22) PCT Filed: Jul. 7, 2014

(86) PCT No.: PCT/US2014/045613

§ 371 (c)(1),
(2) Date: Jan. 5, 2016

(87) PCT Pub. No.: WO2015/003187

PCT Pub. Date: Jan. 8, 2015

(65) Prior Publication Data

US 2016/0152461 A1 Jun. 2, 2016

Related U.S. Application Data

(60) Provisional application No. 61/843,309, filed on Jul. 5, 2013.

(51) Int. Cl.
*B67D 1/08* (2006.01)
*B67D 1/00* (2006.01)

(52) U.S. Cl.
CPC ..... *B67D 1/0841* (2013.01); *B67D 1/0081* (2013.01); *B67D 1/0831* (2013.01)

(58) Field of Classification Search
CPC .... B67D 1/0841; B67D 1/081; B67D 1/0831; Y10T 137/612
See application file for complete search history.

(56) References Cited

U.S. PATENT DOCUMENTS 3,353,724 A * 11/1967 Johnston ..... B67D 1/0832 137/212
3,422,448 A * 1/1969 Johnston ..... B67D 1/0832 137/212
3,438,553 A * 4/1969 Johnston ..... B67D 1/0832 222/400.7
3,550,818 A * 12/1970 Johnston ..... B67D 1/0831 222/400.7
3,567,080 A * 3/1971 Johnston ..... B67D 1/0832 222/400.7
3,591,057 A * 7/1971 Johnston ..... B67D 1/0831 222/400.7

(Continued)

FOREIGN PATENT DOCUMENTS

GB 626235 7/1949
WO 2012045676 4/2012

*Primary Examiner* — Craig Schneider
*Assistant Examiner* — Kevin Barss
(74) *Attorney, Agent, or Firm* — Lewis Kohn & Walker LLP; David M. Kohn; Kari Moyer-Henry

(57) ABSTRACT

A keg adapter to alleviate keg valve coupler system incompatibility. The keg adapter has a first end and a second end, the first end being compatible with at least one tap head coupler and having a diameter greater than the second end and the second and being compatible with at least one keg valve system. The keg adapter may be compatible with any combination of tap head coupler and keg valve system. A method of installing the keg adapter onto a keg for dispensing beer is disclosed. Also a method of using a keg adapter to dispense beer from a keg.

11 Claims, 4 Drawing Sheets

(56) References Cited

U.S. PATENT DOCUMENTS 3,591,058 A * 7/1971 Johnston ..... B67D 1/0832 222/400.7
3,599,843 A * 8/1971 Johnston ..... B67D 1/0832 222/399
3,632,023 A * 1/1972 Johnston ..... B67D 1/0831 222/400.7
3,637,117 A * 1/1972 Johnston ..... B67D 1/0831 222/400.7
3,698,417 A * 10/1972 Smith ..... B67D 1/0802 137/212
3,758,008 A * 9/1973 Johnston ..... B67D 1/0831 222/400.7
3,774,820 A * 11/1973 Zucconi ..... B67D 1/0831 222/400.7
3,861,569 A * 1/1975 Johnston ..... B67D 1/0832 222/400.7
3,868,049 A * 2/1975 Johnston ..... B67D 1/0832 137/322
3,878,970 A * 4/1975 Nezworski ..... B67D 1/1247 222/61
3,880,182 A * 4/1975 Johnston ..... B67C 3/30 137/212
3,905,522 A * 9/1975 Johnston ..... B67D 1/0831 137/212
3,913,608 A * 10/1975 Johnston ..... B67D 1/0831 137/322
3,933,282 A 1/1976 Stevens, Jr.
3,993,282 A * 11/1976 Berman ..... E04G 11/42 248/354.4
2006/0032870 A1 2/2006 Murray et al.
2008/0189078 A1* 8/2008 Vok ..... B01F 5/0077 702/188
2013/0008527 A1* 1/2013 Gitlin, Jr. ..... B67D 1/0831 137/317
2014/0124543 A1* 5/2014 Dahl ..... B67D 1/0848 222/400.7
2016/0200561 A1* 7/2016 Dalton ..... B67D 1/0851 137/505

* cited by examiner

KEG ADAPTER APPARATUS, SYSTEMS AND METHODS OF USING SAME

CROSS-REFERENCES TO RELATED PATENT APPLICATIONS

This application is a United States National Stage Application claiming priority under 35 U.S.C. 371 from International Patent Application No, PCT/US14/45613 filed on Jul. 7, 2014, which claims priority from U.S. Provisional Application Ser. No. 61/843,309, filed Jul. 5, 2013, the contents of which are incorporated by reference.

BACKGROUND

Beer is one of the oldest prepared beverages in the world. In most societies, beer is the most popular alcoholic beverage. Various social traditions and activities are associated with beer drinking, such as playing cards, darts, or other pub games; attending beer festivals; visiting a series of pubs in one evening; joining an organization such as CAMRA; visiting breweries; beer-oriented tourism; or rating beer. Drinking games, such as beer pong, are also popular. A relatively new profession is that of the beer sommelier, who informs restaurant patrons about beers and food pairings.

To the average beer drinker, beer is a commodity picked up at the grocery store or ordered at a restaurant or pub. The average beer drinker doesn't concern themselves with the origin of their favorite beer. However, those in the commercial beer industry understand that the origin of a beer is important not only for the qualities of the beer, i.e. color and flavor, but also for the type of dispenser in which the beer is packaged.

Since beer is consumed globally it may not be surprising that beer is imported and exported throughout the world. And despite draught beer from a pressurized keg being the most common method of dispensing in bars around the world, keg valves and taps are not universal around the world, There are six types of valves used in kegs worldwide, generally corresponding to the region where the beer is brewed. Keg valve systems include: A System; D System; G System; M System; S System; and U System. Each valve system requires a specific coupler to tap the keg. Apart from the various couplers used to tap kegs, also required for dispensing are an air or compressed gas line and a beer line from the coupler.

Prior art keg couplers are of a standardized design on their bottom surface so that when connecting a full keg the coupler can be mounted onto a complimentary and also standardized fitting of the keg, and subsequently removed from the fitting upon disconnection of the keg. The actual contact surface of the keg coupler is a radial bearing surface which is mounted onto a corresponding mating surface of the keg fitting, so that the beverage conduit is connected to the riser pipe of the keg.

In use, the coupler is fixed on the keg fitting using a bayonet-like arrangement which itself is made up a cylindrical internal peripheral surface, a lower radial surface, and segmented peripheral surfaces that protrudes inward about the circumference. To connect the keg and the coupler, the segments are inserted from above into corresponding recesses of the keg fitting. The keg coupler is then typically turned about a common axis of keg coupler and a keg fitting, so that the segments then extend under corresponding mating segments of the keg fitting and are wedged into place. A lever on the coupler is then pivoted to establish the connection between a riser pipe of the keg and the beverage conduit leading to a taproom. This pivoting also opens the gas conduit so that the carrier gas can flow into the keg.

In light of the above, it is an object of the present invention to provide the desired features described herein as well as additional advantages of providing a means for eliminating keg valve coupler system incompatibility and enabling bars and restaurants to quickly and easily transfer kegs regardless of the keg valve style.

SUMMARY OF THE INVENTION

The present invention is an adapter for a beverage dispenser, more particularly an adapter for a beer keg. The keg adapter serves as an intermediate device for connecting mismatched types of tap couplers and keg valves. The present invention removes the need for bars and/or restaurants to maintain the exact style of coupler required for each different keg maker and/or brewery. The universality of the keg adapter facilitates the quick and easy transfer of beer kegs from breweries utilizing different style keg valves without the need for changing tap couplers between keg styles. The keg adapter also relieves the pressure on beer distributors to provide a technician for changing couplers when bars and/or restaurants wish to tap kegs with different style valves.

Although the present embodiment is described in the context of beer kegs, the adapter may be used for dispensing any beverage from a pressurized container.

DETAILED DESCRIPTIONS OF THE DRAWINGS

Figure 1:
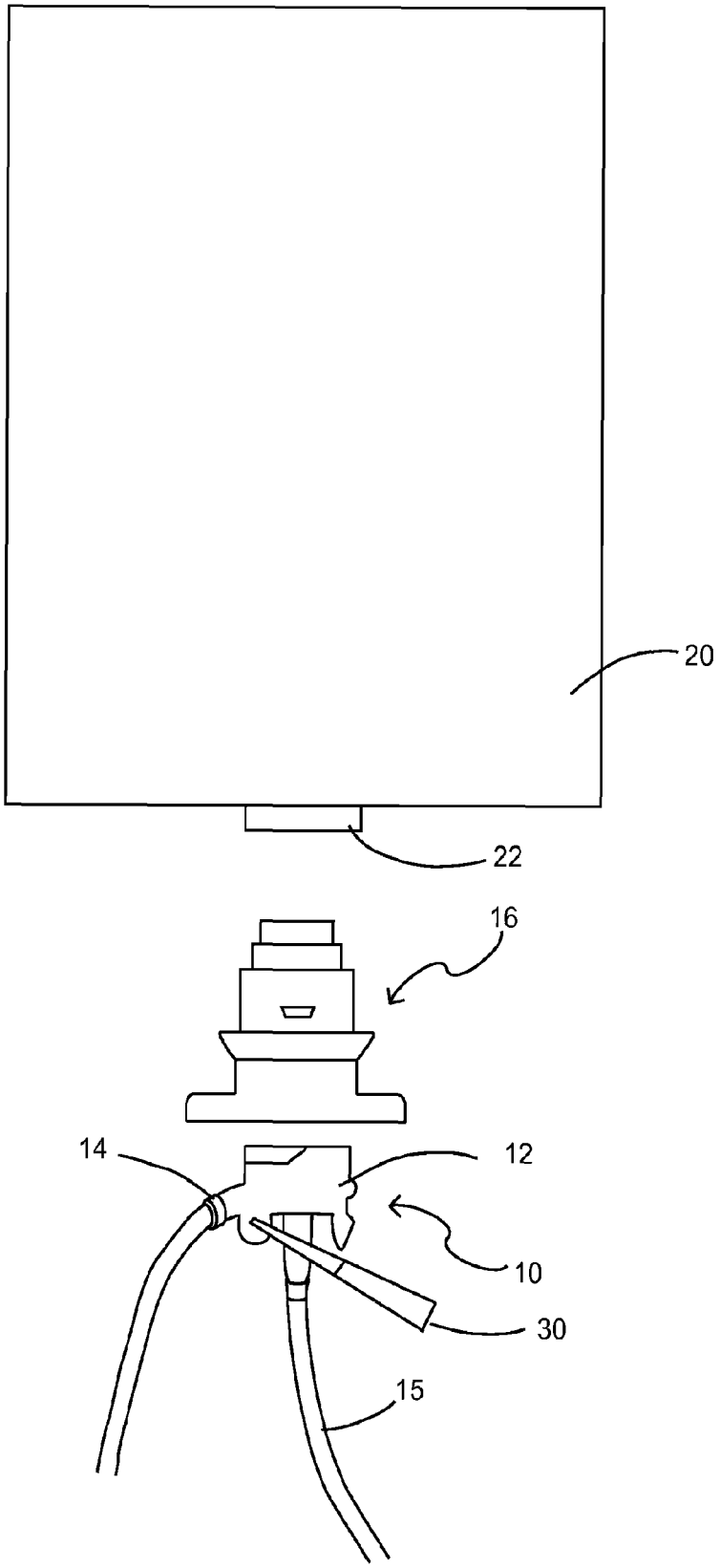
FIG. 1 is a side plan view of the keg adapter of the present invention shown positioned between a beverage container and a tap.

The keg adapter 16 of the present invention is aligned with a tap head 10 with a standard keg fitting and a keg-like container 20 is shown in FIG. 1. The tap head 10 has an axis which, when the keg adapter 16 is used in the intended manner, is a vertical axis. The tap head 10 further comprises a housing 12 with a gas conduit 14 for the introduction of pressurized gas and a beverage conduit 15 for leading a beverage to a bar tap (not shown). The pressurized gas may be pressurized air or carbon dioxide. At the top of the tap head 10 is a lever system 30 which controls the release of the pressurized gas and thereby the flow of the beverage from the keg-like container 20. The housing 12 further includes a slidably moveable guide arranged on the underside of the housing 12 for enabling the housing 12 to be pushed in the known manner onto the keg fittings 22 of the keg-like container 20. The tap head 10 can be connected to the keg adapter 16 which is then connected to the keg fitting 22 of the container 20 such that the tap head 10, keg adapter 16 and the container 20 are connected in a secure and sealed continuous system.

The keg adapter 16 may be designed to work with any commercially standard keg fitting coupler 22 design and any commercially standard tap head 10 design. At the bottom of a typical tap head 10 is a conical section adjoined at its bottom by a lower section (not shown). This lower section is primarily provided for the connection to a keg fitting 22 on a container 20 or, in the context of the present invention, for connection to a keg adapter 16.

Figure 2:
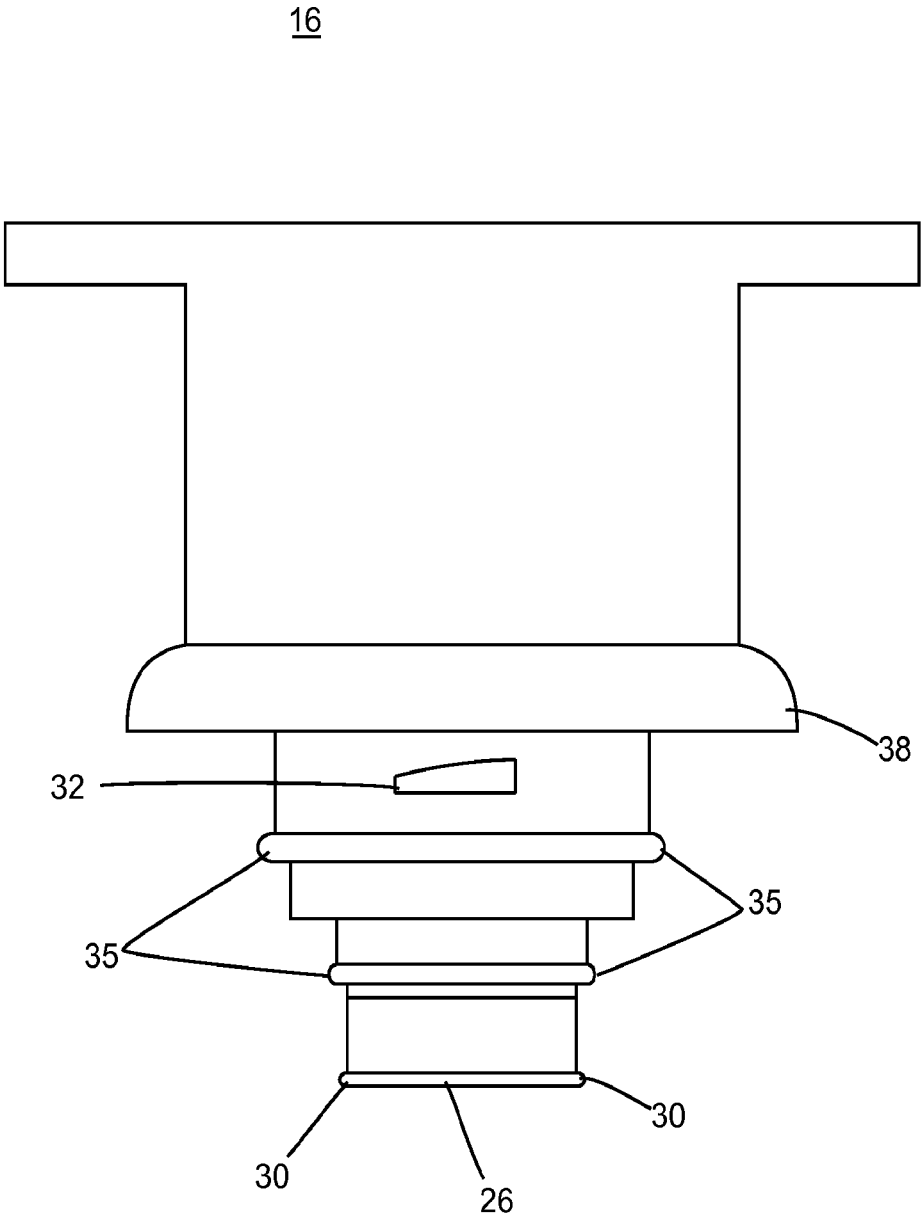
FIG. 2 illustrates a side view of the keg adapter of the present invention.

With regard to FIG. 2, a side view of the keg adapter 16 is illustrated. The diameter of keg adapter 16 is tapered from the top (Y) of the adapter to the bottom such that the keg adapter 16 will mate snuggly with the neck of a standard keg valve (not shown). To further ensure the snug fit of the keg adapter 16 with the keg fitting 22, the keg adapter 16 further includes a series of threads 35 corresponding to the grooves inside a standard keg fitting 22. The lower section of the keg adapter 16 is made up of a cap extension 26 which is externally delimited by a cylindrical external peripheral surface or line. On the underside of cap extension 26 there is a radial end face 28 (not shown), which is formed partially by projections 30 which protrude radially from cap extension 26. Collar piece 38 extends radially from the keg adapter 16 to a sufficient diameter such that the collar piece 3 rests on top of a standard keg fitting 22. Also shown are keg lock tabs 32 which are positioned opposite each other on either side of keg adapter 16 for locking the keg adapter 16 to the a standard keg fitting 22.

Figure 3:
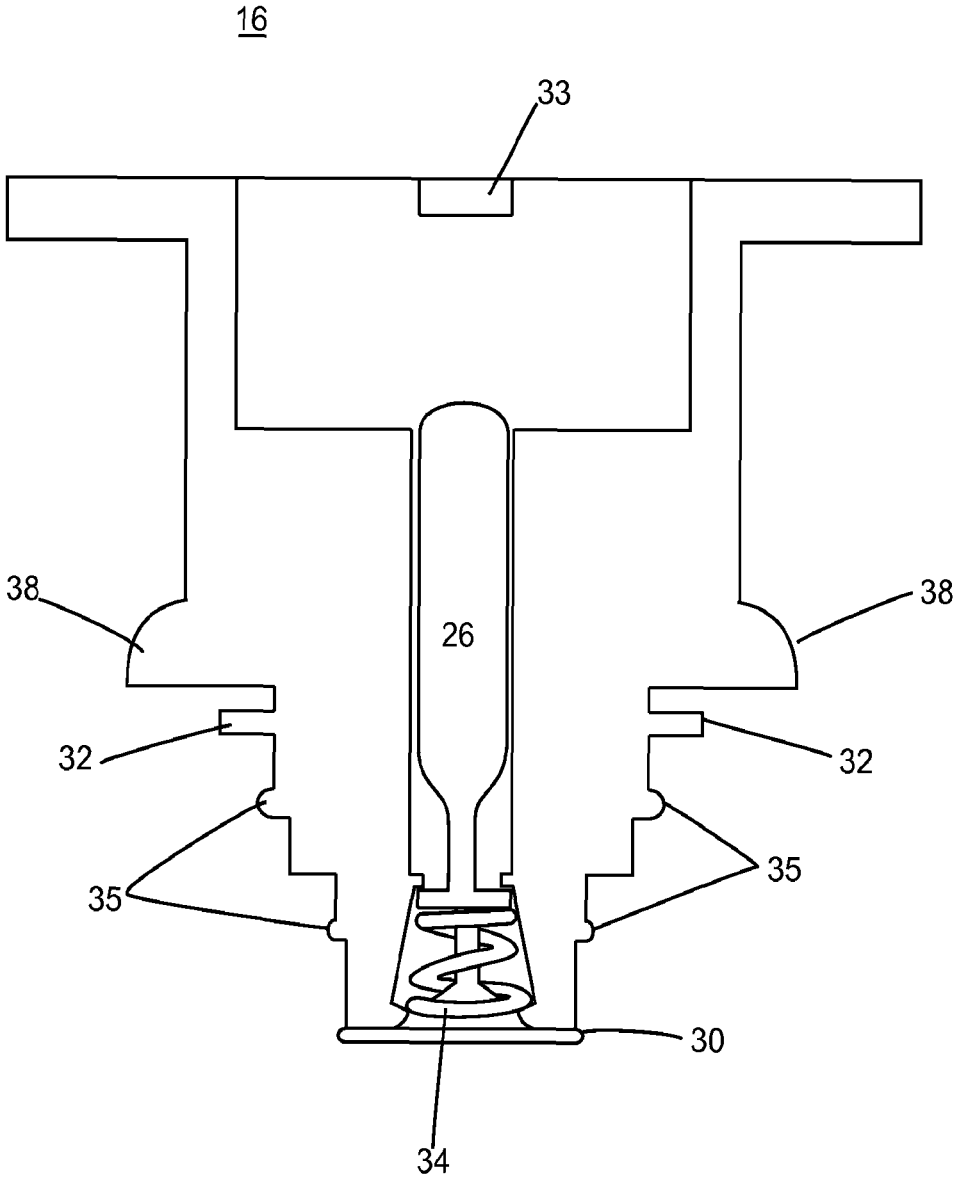
FIG. 3 is a cross-section view of the keg adapter shown FIG. 2.

With regard to FIG. 3, a cross-section view of the keg adapter 16 shown in FIG. 2 is illustrated. Particularly shown in FIG. 3 is the remainder of cap extension 26 through the center of keg adapter 16 in the shape of an ampule with the upper end protruding slightly into the tap head cutout located at the top of the keg adapter 16. Tension spring 34 maintains cap extension 26 in a closed position when the lever system (not shown) in in the "closed" orientation, i.e. during the changing of empty kegs. Tap lock tab 33 is shown at the top most of keg adapter 16 and secures the tap head (not shown) to the top of the keg adapter 16.

Figure 4:
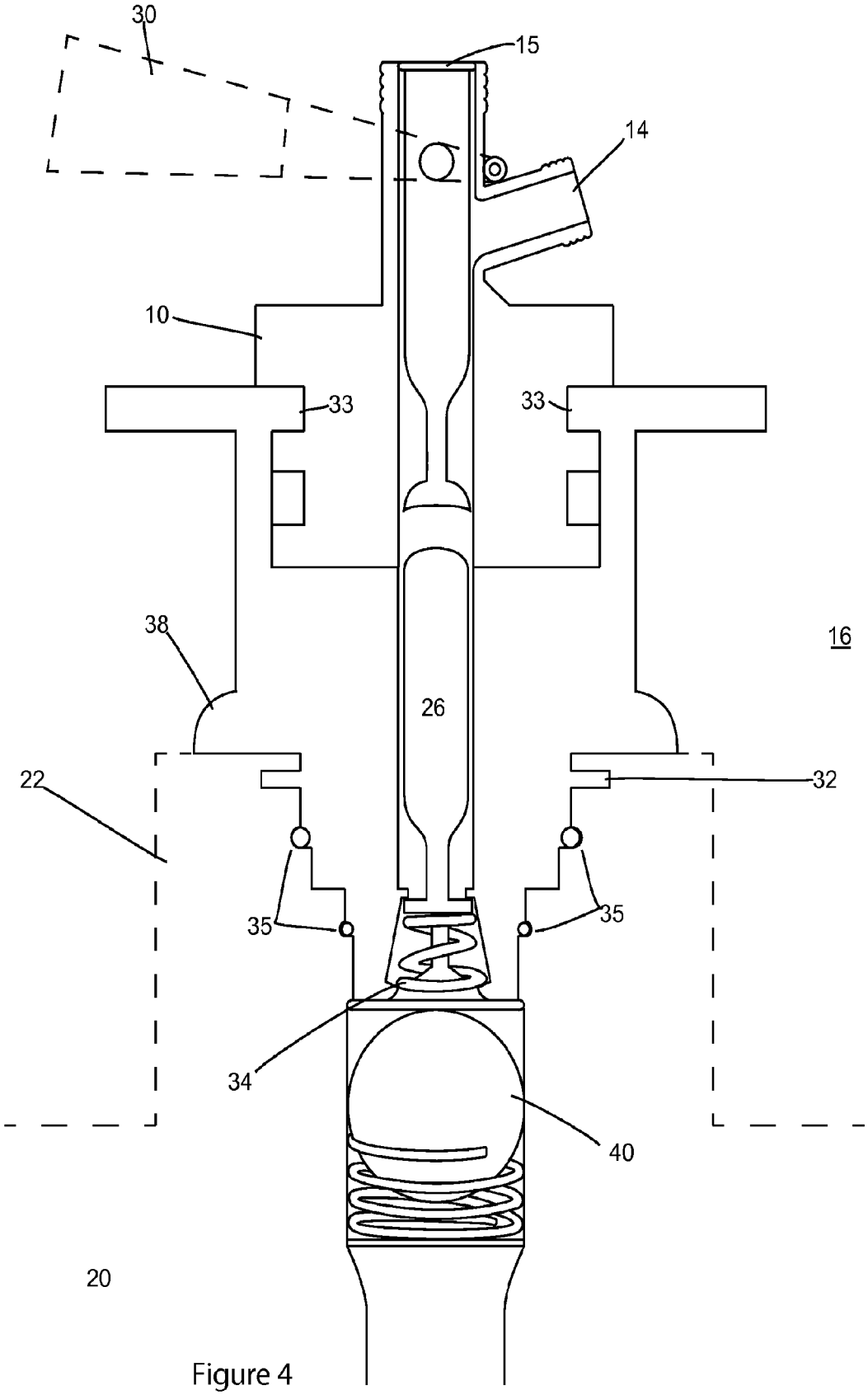
FIG. 4 is a cross-section view of the keg adapter of FIG. 3 shown attached positioned between a keg and tap coupler.

With regard to FIG. 4, a cross-section of the keg adapter 16 in use connecting a foreign, non-US type keg fitting 22, with a coupler 10 for an American tap. By way of example only, the foreign keg fitting shown in FIG. 4 is a Type U valve and the American tap head is a Type D coupler. Table 1 provides further examples of beer brands which require specific style couplers in order to tap a commercial keg of a given beer brand. In a preferred embodiment the keg adapter 16 may be designed to work with any commercially standard keg fitting coupler 20 design and any commercially standard tap head 10 design. The keg adapter 16 is secured to the keg fitting 22 using keg lock tabs 32 and threads 35 such that the cap extension 26 of the keg adapter 16 rests flushly on top of the keg valve and the seal between the keg fitting 22 and the keg adapter 16 is water tight. Tap head 10 is secured to the top of the keg adapter 16 using tap lock tabs 33 also creating a water tight seal between the tap head 10 and the keg adapter 16. Once the system is securely assembled, the lever system 30 is moved to the "open" position thereby simultaneously forcing the cap extension 26 downward toward the keg fitting 22 and allowing pressurized gas to enter the system. The downward movement of the cap extension 26 forces the keg valve 40 on the keg fitting 22 into an open position. Once the valve 40 is open, pressurized gas from gas conduit 14 enters the keg and displaces the liquid contained in the keg out of the keg into beverage conduit 15 connected to a tap for dispensing, Reversing the lever system 30 results in the return of the keg valve 40 to the closed position and the tension spring 34 retuning the cap extension 26 to the closed position.

TABLE 1

| Beer brands according to coupler style | | | | | |
|---|---|---|---|---|---|
| Type Sankey "D" | Type "S" | Type "A" | Type "G" | Type "U" | Type "M" |
| Anheuser-Busch | Amstel | Ayinger | Anchor | Guinness | Schneider |
| Boston | Becks | Bitburger | Bass | Harp | Veltins |
| | | Pilsner | | | |
| Miller | Belle-Vue | De Koninck | Boddingtons | John Courage | Zywiec |
| Molson Coors | Erdinger | Fischer | Fullers | Smithwicks | |
| New Belgium | Heineken | Isenbeck | Grolsch | | |
| Rolling Rock | Limdeman's | Lowenbrau | Old Speckled Hen | | |
| Sam Adams | Murphy's | Paulaner Lager | Tennents | | |
| Sierra Nevada | Pilsner Urquell | Spaten | Watney's | | |
| Scottish & Newcastle | Saint Pauli Girl | Victoria | | | |

The keg adapter 16 of the present invention has a first end and a second end, the first end being compatible with at least one tap head coupler and having a diameter greater than the second end and the second end being compatible with at least one keg valve system. The keg adapter 16 further includes a central opening extending vertically through the interior of the keg adapter 16 from the first end to the second end through which a pressurized beverage may flow for dispensing. The central opening is further comprised of a cap extension 26 and tension spring 34 such that when the cap extension is engaged by a tap head coupler, the cap extension 26 is forced in a downward vertical direction thereby forcing the end face 28 of the cap extension 26 to engage with the keg valve 40 and force the keg valve 40 into an open position further allowing pressurized gas to enter a keg and subsequently force beer from the keg through the keg valve 40 and keg adapter 16 and finally to the tap for dispensing.

One embodiment of the present invention provides a keg adapter to alleviate keg valve coupler system incompatibility. In a preferred embodiment, the keg adapter may be compatible with a tap head coupler selected from the group consisting of the A coupler System, the D coupler System, the U coupler System, the M coupler System, the S coupler System, and the U coupler System. In another preferred embodiment, the keg adapter may be compatible with a keg fitting selected from the group consisting of A valve System, the D valve System, the U valve System, the M valve System, the S valve System, and the U valve System. In a most preferred embodiment, the keg adapter may be compatible with any combination of tap head coupler and keg valve system.

In another embodiment, the keg adapter may be easily changed by a bar or restaurant employee as needed when exchanging an empty keg with a new keg requiring a different keg adapter. In a preferred embodiment, the keg adapter may be pre-attached to each keg when delivered by a distributor such that a restaurant or bar simply orders a keg with the specific keg adapter compatible with their existing tap system such that each keg is ready to be connected to their system regardless of the valve system of the keg.

In yet another embodiment, the present invention provides a keg adapter manufactured from any non-corrosive material suitable for use with beverage dispensing such that the material will not impact the taste and smell of the beverage due to exposure over time and to minimize the incidence of microbial growth, In a preferred embodiment, the keg adapter may be manufactured from stainless steel, plastic, PVC, and copper. in a preferred embodiment, the keg adapter may be manufactured from stainless steel.

In still another embodiment, the present invention provides a method for installing a keg adapter in a system for beer dispensing, the method comprising:

a) obtaining a keg requiring dispensing of its contents;

b) identifying the keg fitting and valve system of the keg in step a);

c) obtaining a keg adapter with a first end and a second end, wherein the second end is compatible with the valve system identified in step b) and first end is compatible with the tap head coupler available fur dispensing beer;

d) positioning the second end of keg adapter onto the keg fitting and securing the keg adapter to the keg fitting by turning the keg adapter in a clockwise direction until the keg adapter and keg fitting form a water tight seal;

e) positioning the tap head coupler at the first end if the keg adapter and securing the tap head. coupler to the keg adapter by turning the tap head coupler in the clockwise direction until the tap head coupler and the keg adapter form a water tight seal.

In yet another embodiment, the present invention provides a method of using a keg adapter 16 to dispense beer from a keg, wherein the keg adapter 16 includes: a first end and a second end, the first end being compatible with at least one tap head coupler and having a diameter greater than the second end and the second end being compatible with at least one keg valve system. The keg adapter 16 further includes a central opening extending vertically through the interior of the keg adapter 16 from the first end to the second end through which a pressurized beverage may flow for dispensing. The central opening is further comprised of a cap extension 26 and tension spring 34 such that when the cap extension is engaged by a tap head coupler, the cap extension 26 is forced in a downward vertical direction thereby forcing the end face 28 of the cap extension 26 to engage with the keg valve 40 and force the keg valve 40 into an open position further allowing pressurized gas to enter a keg and subsequently force beer from the keg through the keg valve 40 and keg adapter 16 and finally to the tap for dispensing.

I claim:

1. A keg adapter for dispensing beer from a keg, the keg adapter comprising: a first end and a second end, the first end being compatible with at least one tap head coupler and having a diameter greater than the second end and the second end being compatible with at least one keg valve system, wherein the keg adapter further includes a central opening extending vertically through the interior from the first end to the second end through which a pressurized beverage may flow for dispensing and wherein the central opening further includes a cap extension and tension spring such that when the cap extension is engaged by a tap head coupler, the cap extension is forced in a downward vertical direction thereby forcing the end face of the cap extension to engage with the keg valve and force the keg valve into an open position further allowing pressurized gas to enter a keg and subsequently force beer from the keg through the keg valve and keg adapter and finally to a tap for dispensing.

2. The keg adapter of claim 1, wherein the first end is compatible with a tap head coupler selected from the group consisting of the A coupler System, the D coupler System, the G coupler System, the M coupler System, the S coupler System, and the U coupler System.

3. The keg adapter of claim 1, wherein the second end is compatible with a keg fitting selected from the group consisting of A valve System, the D valve System, the G valve System, the M valve System, the S valve System, and the U valve System.

4. The keg adapter of claim 1, wherein the tap head coupler compatible with the first end and the keg valve system compatible with the second end are not compatible with each other.

5. A method for installing a keg adapter, the method comprising:

a) obtaining a keg requiring dispensing of its contents;

b) identifying the keg fitting and valve system of the keg in step a);

c) obtaining a keg adapter with a first end and a second end, wherein the second end is compatible with the valve system identified in step b) and first end is compatible with the tap head coupler available for dispensing beer;

d) positioning the second end of keg adapter onto the keg fitting and securing the keg adapter to the keg fitting by turning the keg adapter in a clockwise direction until the keg adapter and keg fitting form a water tight seal;

e) positioning the tap head coupler at the first end if the keg adapter and securing the tap head coupler to the keg adapter by turning the tap head coupler in the clockwise direction until the tap head coupler and the keg adapter form a water tight seal.

6. The method of claim 5, wherein the first end of the keg adapter is compatible with a tap head coupler selected from the group consisting of the A coupler System, the D coupler System, the G coupler System, the M coupler System, the S coupler System, and the U coupler System.

7. The method of claim 5, wherein the second end is compatible with a keg fitting selected from the group consisting of A valve System, the D valve System, the G valve System, the M valve System, the S valve System, and the U valve System.

8. A method of using a keg adapter to dispense beer from a keg, wherein the keg adapter is comprised of: a first end and a second end, the first end being compatible with at least one tap head coupler and having a diameter greater than the second end and the second end being compatible with at least one keg valve system, wherein the keg adapter further includes a central opening extending vertically through the interior from the first end to the second end through which a pressurized beverage may flow for dispensing and wherein the central opening further includes a cap extension and tension spring such that when the cap extension is engaged by a tap head coupler, the cap extension is forced in a downward vertical direction thereby forcing the end face of the cap extension to engage with the keg valve and force the keg valve into an open position further allowing pressurized gas to enter a keg and subsequently force beer from the keg through the keg valve and keg adapter and finally to a tap for dispensing.

9. The method of claim 8, wherein the first end is compatible with a tap head coupler selected from the group consisting of the A coupler System, the D coupler System, the G coupler System, the M coupler System, the S coupler System, and the U coupler System.

10. The method of claim 8, wherein the second end is compatible with a keg fitting selected from the group consisting of A valve System, the D valve System, the G valve System, the M valve System, the S valve System, and the U valve System.

11. The method of claim 8, wherein the tap head coupler compatible with the first end and the keg valve system compatible with the second end are not compatible with each other.

* * * * *